United States Patent [19]

Hozumi et al.

[11] Patent Number: 4,992,767

[45] Date of Patent: Feb. 12, 1991

[54] MAGNET ROLL

[75] Inventors: Waichi Hozumi, Fukaya; Keitaro Yamashita, Kamisato, both of Japan

[73] Assignee: Hitachi Metals, Ltd., Tokyo, Japan

[21] Appl. No.: 461,301

[22] Filed: Jan. 5, 1990

[30] Foreign Application Priority Data

Feb. 3, 1989 [JP] Japan ..... 1-25223

[51] Int. Cl.[5] ..... H01F 13/00

[52] U.S. Cl. ..... 335/284; 335/306; 118/657

[58] Field of Search ..... 335/284, 306; 118/657, 118/658; 29/123

[56] References Cited

U.S. PATENT DOCUMENTS 4,167,718 9/1979 Harada et al. ..... 335/284

FOREIGN PATENT DOCUMENTS 59-161156 10/1984 Japan .
60-5537 2/1985 Japan .
62-32295 8/1987 Japan .
62-32296 8/1987 Japan .
62-35090 9/1987 Japan .
899634 6/1962 United Kingdom ..... 335/306

*Primary Examiner*—George Harris
*Attorney, Agent, or Firm*—Finnegan, Henderson, Farabow, Garrett & Dunner

[57] ABSTRACT

The magnet roll according to the present invention comprises (a) first and second shafts rotatable around the same axis relative to each other; (b) a permanent magnet member fixed around the second shaft and having a plurality of magnetic poles extending along the axis of the second shaft on its outer surface; (c) a first flange member connected to the first shaft and rotatably supporting one end of the second shaft; (d) a second flange member rotatably supported by the second shaft; (e) a hollow cylindrical sleeve made of a plastically deformable non-magnetic material and fixed to the first and second flange members on both ends such that it encircles the permanent magnet member rotatably relative to the permanent magnet member; and (f) an inner diameter-increased area provided in each side end portion of the sleeve, which receives each flange member and is folded inward over each flange member to fix the sleeve to each flange member.

6 Claims, 2 Drawing Sheets

MAGNET ROLL

BACKGROUND OF THE INVENTION

The present invention relates to a magnet roll for use as a developing roll or a cleaning roll in electrophotography, electrostatic recording, etc.

A conventional magnet roll used as a developing roll or a cleaning roll in electrophotograpy, electrostatic recording, etc. generally has a structure shown in FIG. 11. In FIG. 11, 1 denotes a permanent magnet member made of a sintered magnet material such as hard ferrite or a bonded magnet material consisting of ferromagnetic powder and a binder in the shape of an integral cylinder, and it is concentrically fixed onto a central shaft 2. The permanent magnet member 1 is provided with a plurality of magnetic poles (not shown) extending along the axis of the permanent magnet member on its outer surface. Flange members 3, 4 are rotatably mounted to both end portions of the shaft 2 via bearings 5*a*, 5*b*, and a hollow cylindrical sleeve 6 is fixed to the flange members 3, 4. The flange members 3, 4 and the sleeve 6 may be made of non-magnetic materials such as aluminum alloys, stainless steel, etc. A shaft 7 is fixed to the flange member 3. Numeral 8 denotes a seal member mounted between the flange member 4 and the shaft 2. In a typical example, the permanent magnet member 1 has a diameter of 20–60 mm and a length of 200–350 mm.

By the above structure, the permanent magnet member 1 and the sleeve 6 are rotatable relative to each other (for instance, the permanent magnet member 1 i stationary while the shaft 7 is rotated). When the magnet roll is used in a developing apparatus, a magnetic brush of a magnetic developer is formed on the outer surface of the sleeve 6 to conduct development. Or when it is used as a cleaning roll, an excess magnetic developer is removed from the surface of a photosensitive drum in a cleaning area.

However, since the above conventional magnet roll is constituted by many parts, it takes much time and needs much labor to assemble the magnet roll, inevitably leading to high costs. Particularly, the sleeve 6 and the flange members 3, 4 should be integrally fixed to each other to prevent their relative rotation, and these parts are generally fixed by an adhesive. However, since bonding areas of these parts to which the adhesive can be applied are relatively small, it is difficult to achieve high adhesion strength between these parts. In addition, an excess adhesive may attach to undesired areas of the sleeve 6 and the flange members 3, 4. Accordingly, a circumferential or axial relative rotation may take place between the sleeve 6 and flange members 3, 4. When a powdery adhesive is used, masking should be carried out to prevent the application thereof to undesired areas. In this case, the bonding operation between the sleeve 6 and the flange members 3, 4 are extremely troublesome, needing more time and labor, which leads to lower productivity. Further, the above difficulties are likely to lead the deterioration in quality of the assembled magnet rolls. Particularly, since low-priced, compact copying machine sand printers are strongly desired in recent years, the conventional magnet rolls of the above structure fail to satisfy such demands.

On the other hand, as measures for fixing the sleeve 6 to the flange members without using adhesives, the side end portion of the sleeve 6 may be subjected to caulking, drawing, curling, etc. to fix them to the flange members 3, 4. See, for instance, Japanese Utility Model Publication Nos. 60-5537, 62-32295, 62-32296, 62-35090, etc. However, in these measures, the working of the portions is still troublesome, and sufficient fixing strength and accuracy cannot be achieved.

Japanese Utility Model Laid-Open No. 59-161156 discloses a magnet roll comprising flange members provided with several notches on their circumferential surfaces, into which part of the sleeve end can be fitted. However, since this structure provides small deformed portions, sufficient fixing strength cannot be achieved. In addition, developer powder is likely to enter the notches and further intrude into the inside of the magnet roll.

Incidentally, this reference shows in FIGS. 14 to 16 a magnet roll having a structure in which flange members having thin notches on the entire circumferential surfaces are received in side end portions of the sleeve, and the side end portions of the sleeve are bent inward by drawing to fix the sleeve to the flange members. However, in such a structure, if the side end portions of the sleeve are not sufficiently deformed, namely, if the deformed portions 23 are not surely attached to the end surfaces of the flange members, sufficient fixing strength cannot be obtained to completely prevent the rotation of the flange members. Further, in the drawing operation of the sleeve, the positions of the portions to be drawn cannot easily be determined.

OBJECT AND SUMMARY OF THE INVENTION

Accordingly, an object of the present invention is to provide a compact and inexpensive magnet roll which has a simple structure and is easy to assemble.

The magnet roll according to the present invention comprises (a) first and second shafts rotatable around the same axis relative to each other; (b) a permanent magnet member fixed around the second shaft and having a plurality of magnetic poles extending along the axis of the second shaft on its outer surface; (c) a first flange member connected to the first shaft and rotatably supporting one end of the second shaft; (d) a second flange member rotatably supported by the second shaft; (e) a hollow cylindrical sleeve made of a plastically deformable non-magnetic material and fixed to the first and second flange members on both ends such that it encircles the permanent magnet member rotatably relative to the permanent magnet member; and (f) an inner diameter-increased area provided in each side end portion of the sleeve, which receives each flange member and is folded inward over each flange member to fix the sleeve to each flange member.

DETAILED DESCRIPTION OF THE INVENTION

Figure 1:
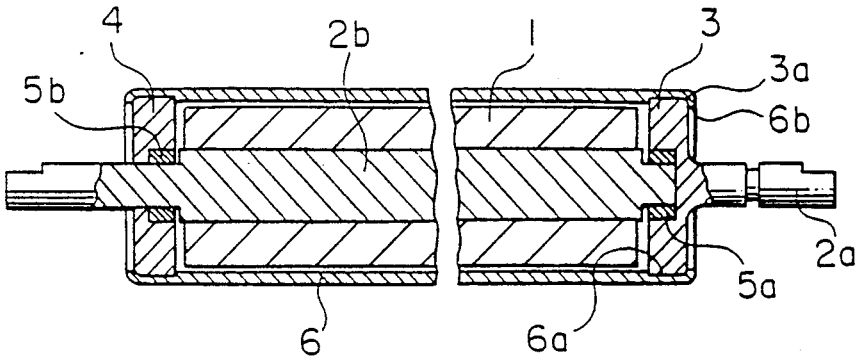
FIG. 1 is a partial cross-sectional view showing the magnet roll according to a first embodiment of the present invention.
Figure 2:
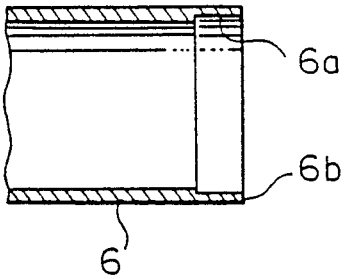
FIG. 2 is a partial cross-sectional view showing a sleeve in FIG. 1.
Figure 3:
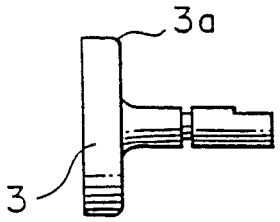
FIG. 3 is a side view showing a flange member in FIG. 1.

Referring to FIGS. 1—3, the magnet roll according to the first embodiment of the present invention comprises a permanent magnet member 1 fixed around a second shaft 2*b*, a first flange member 3 integrally connected to a first shaft 2*a* and rotatably supporting one end of the second shaft 2*b*. The second flange member 4 is rotatably supporting the second shaft 2*b* on the other side thereof. A hollow cylindrical sleeve 6 made of a non-magnetic material is fixed is both first and second flange members 3, 4 on both side ends so that the sleeve 6 is rotatable relative to the permanent magnet member 1. Incidentally, the relative rotation of the permanent magnet member 1 and the sleeve 6 means that either one of the permanent magnet member 1 and the sleeve 6 can be rotated while the other member is stationary or rotated at a different speed.

As is clearly shown in FIG. 2, the sleeve 6 has an inner diameter-increased area 6*a* at each side end portion 6*b*, and the inner diameter-increased area 6*a* has an inner diameter which can receive the flange member 3 with substantially no gap therebetween. As shown in FIG. 3, the flange member 3 may have a chamfered portion 3*a* at an outer edge portion. This chamfered portion 3*a* may be provided with a serration knurl. The same is true of the flange member 4. Namely, it may have a serration knurl in a chamfered portion provided on its outer edge portion.

Because of the above structure, in the fixing of the sleeve 6 to the flange member 3, the flange member 3 is first introduced into the inner diameter-increased area 6*a* of the sleeve 6, and then the side end portion 6*b* of the sleeve 6 is folded inward onto the chamfered portion 3*a* of the flange member 3 having a serration knurl. After mounting the permanent magnet member 1 fixed around the second shaft 2 to the first flange member 3, the second flange member 4 rotatably mounted to the second shaft 2*b* is fixed to the left side end portion of the sleeve 6. The above structure achieves the strong fixing of the sleeve 6 to the flange member 3, 4, preventing the axial and circumferential movement of the flange members 3, 4. For instance, when flange members 3, 4 made of aluminum A2017 are fixed to a sleeve 6 made of aluminum A6063 having an outer diameter of 24 mm and a thickness of 1 mm, high fixing strength such as an axial detachment strength of 50 kgf or more, a fixing torque of 20 kgf·cm or more, and a cantilever load of 50 kgf or more can be achieved.

Incidentally, depending upon the operation conditions of the magnet roll, for instance, when the rotation speed of the sleeve 6 is low, lower fixing strength than the above level would not cause practical problems. In such a case, knurl can be omitted and the chamfered portion 3*a* may also be omitted.

Figure 4:
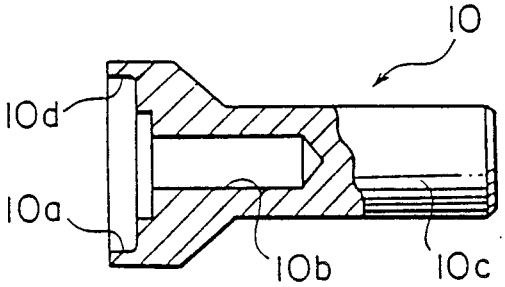
FIG. 4 is a cross-sectional view showing a jig for folding the side end portion of the sleeve in the first embodiment.

FIG. 4 shows a typical jig for use on the magnet roll according to the first embodiment. The jig 10 has a recess 10*a* on one side end, the recess 10*a* has a blind hole 10*b*. The jig 10 has a shank portion 10*c* on the other side. Incidentally, an inner diameter of the recess 10*a* is slightly larger than an outer diameter of the sleeve 6 shown in FIGS. 1 and 2. The recess 10*a* also has a round bottom corner 10*d* having the corresponding shape to that of the chamfered portion 3*a* of the flange member 3 shown in FIG. 3.

This jig 10 is used to fold the side end portion 6*b* of the sleeve 6. Specifically, in a state where the first flange member 3 is received in the inner diameter-increased area 6*a* of the sleeve 6, the first shaft 2*a* is inserted into the blind hole 10*b* of the jig 10 so that the extending side end portion 6*b* of the sleeve 6 is received in the recess 10*a*. In this state, when the jig 10 is pushed forward, the side end portion 6*b* of the sleeve 6 is easily folded inward by the round bottom corner 10*d* of the recess 10*a*. Thus, the side end portion 6*b* of the sleeve 6 is strongly fixed onto the chamfered portion 3*a* provided with a serration knurl. Incidentally, the jig 10 can be pushed axially by any means such as a press means or a hammer.

Figure 5:
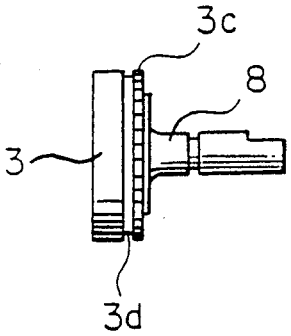
FIG. 5 is a side view showing a flange member according to a second embodiment of the present invention.

FIG. 5 shows a flange member according to the second embodiment of the present invention. This flange member 3 has a serration knurl 3*c* on at least a part of its circumferential surface. Numeral 3*d* denotes an annular groove. This flange member 3 can be used in combination with a sleeve having an inner diameter-increased area 6*a* as in FIG. 2. This flange member 3 is inserted into the inner diameter-increased area 6*a* of the sleeve 6 shown in FIG. 2, and the side end portion 6*b* is folded inward over the flange member 3 to fix them. In this case, since the serration knurl 3*c* is slightly pressed into the inner diameter-increased area 67*a* of the sleeve 6 in the fixing process, the circumferential fixing strength therebetween is extremely high.

Figure 6:
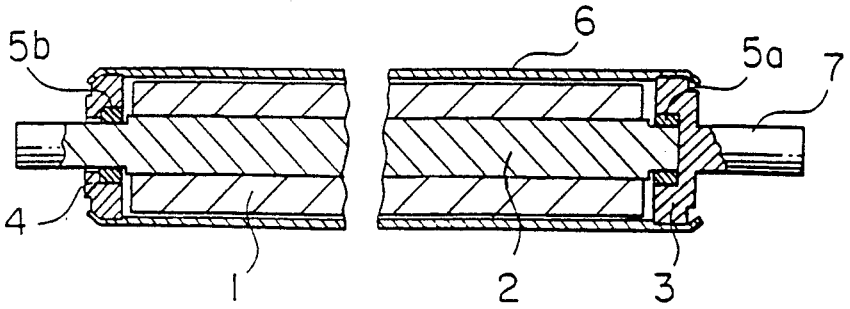
FIG. 6 is a partial cross-sectional view showing the magnet roll according to a third embodiment of the present invention.
Figure 7:
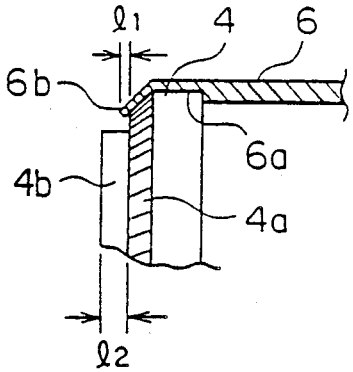
FIG. 7 is a partially enlarged view showing a flange member in FIG. 6.
Figure 8:
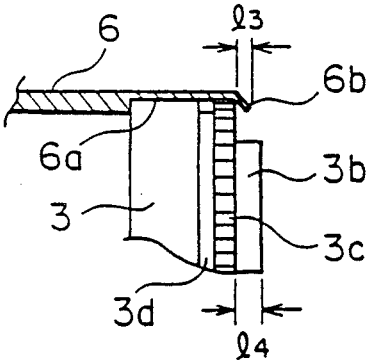
FIG. 8 is a partially enlarged view showing another flange member in FIG. 6.

FIGS. 6–8 show flange members 3, 4 according to the third embodiment of the present invention. The flange member 4 is provided with a slanted surface 4*a* at an outer edge portion, and this slanted surface 4*a* is provided with a serration knurl. The flange member 4 is also provided with a diameter-reduced portion 4*b* at its side end. On the other hand, the flange member 3 has a serration knurl on at least a part of its circumferential surface and is also provided with a diameter-reduced portion 3*b* at its side end. Each diameter-reduced portion 3*b*, 4*b* has an axial length $l_2$, $l_4$, larger than a length $l_1$, $l_3$ of an excess portion of each folded side end portion 6*b* of the sleeve 6.

By this structure, when the magnet roll is assembled in a developing apparatus, the side end portions 6*b* of the sleeve 6 do not interfere with other members in the developing apparatus. In this embodiment, knurl or chamfering can be omitted depending upon the use conditions of the magnet roll.

Figure 9:
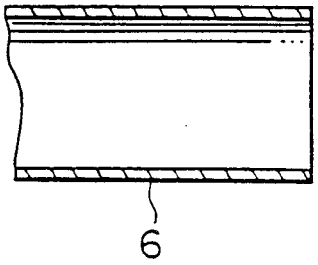
FIG. 9 is a cross-sectional view showing a sleeve according to a fourth embodiment of the present invention.
Figure 10:
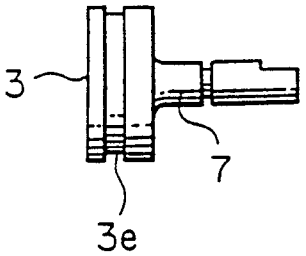
FIG. 10 is a side view showing a flange member according to the fourth embodiment of the present invention.
Figure 11:
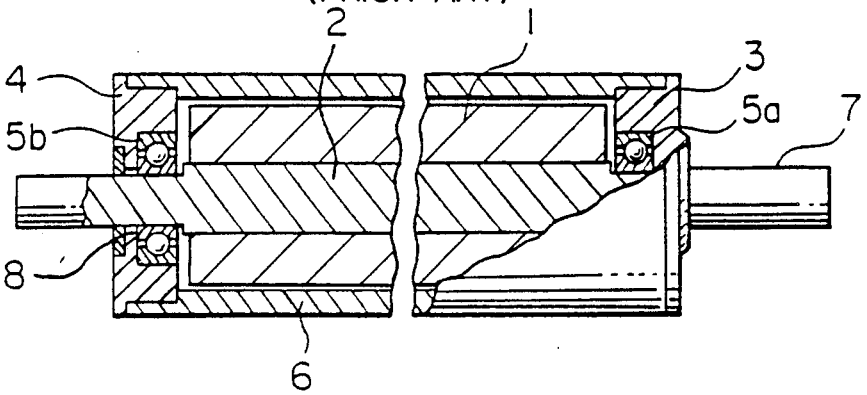
FIG. 11 (PRIOR ART)
FIG. 11 is a partial cross-sectional view showing a conventional magnet roll.

FIGS. 9 and 10 show a sleeve and a flange member according to the fourth embodiment of the present invention. The sleeve 6 has a length slightly smaller the length after fixing, and an outer diameter and a thickness slightly larger than those after fixing. The flange emember 3 is provided with an annular groove 3*e* on its circumferential surface.

The fixing of the sleeve 6 to the flange members 3, 4 may be conducted by cold working. For instance, the sleeve 6 and the flange member 3 are placed in a hydraulic press (not shown) in such a state that the flange member 3 is received in the sleeve 6. Next, the hydraulic press is operated to press the sleeve 6 onto the flange member 3 so that a part of the sleeve 6 is thinned and enters into the annular groove 3*e* of the flange member 3, to integrally fix the sleeve 6 to the flange member 3. Instead of the annular groove 3*e*, an annular projection may also be used to achieve the same effect. This structure may be applied to either of flange members 3, 4, but great advantage is obtained when it is applied to the flange member 3 on the driving side because a fixing torque of 50 kfg·cm or more is obtained.

In the above embodiments, the chamfered portion of the flange member is not limited to have a circular cross section, and a flat chamfered portion may also be formed. With respect to a knurl, it may be not only in the form of a serration but also in the form of slanted lines or crossed lines. Further, the flange members can be fixed to both sides of the sleeve by different fixing means.

As described above, in the magnet roll of the present invention, the sleeve can be strongly fixed to the flange members without using an adhesive. Therefore, the relative rotation of the flange members to the sleeve in axial and circumferential directions can be completely prevented. Also, the fixing of the sleeve to the flange members can be conducted automatically, thereby drastically increasing the reliability of the assembled magnet rolls. Therefore, it is possible to produce compact magnet rolls inexpensively.

What is claimed is:

1. A magnet roll comprising:

(a) first and second shafts rotatable around the same axis relative to each other;

(b) a permanent magnet member fixed around said second shaft and having a plurality of magnetic poles extending along the axis of said second shaft on its outer surface;

(c) a first flange member connected to said first shaft and rotatably supporting one end of said second shaft;

(d) a second flange emember rotatably supported by said second shaft;

(e) a hollow cylindrical sleeve made of a plastically deformable non-magnetic material and fixed to said first and second flange members on both ends such that it encircles said permanent magnet member rotatably relative to said permanent magnet member; and (f) an inner diameter-increased area provided in each side end portion of said sleeve, which receives each flange member and is folded inward over each flange member to fix said sleeve to each flange member.

2. The magnet roll according to claim 1, wherein an outer edge of each flange member is chamfered.

3. The magnet roll according to claim 2, wherein said chamfered portion of said flange member is provided with a knurl.

4. The magnet roll according to claim 1, wherein said flange members are provided with a serration knurl on at least part of their circumferential surfaces, thereby fixing said sleeve to said flange members further strongly.

5. The magnet roll according to claim 1, wherein said flange member is provided with a diameter-reduced portion on its outer end surface, the axial length of said diameter-reduced portion being longer than an excess portion of the folded side end portion of said sleeve.

6. The magnet roll according to claim 1, wherein one of said flange members is provided with an annular groove or annular projection on its circumferential surface, to which the side end portion of said sleeve is integrally fixed by cold working.

* * * * *